US010923795B2

(12) United States Patent
Dai

(10) Patent No.: US 10,923,795 B2
(45) Date of Patent: Feb. 16, 2021

(54) HIDDEN MULTI-BAND WINDOW ANTENNA

(71) Applicant: David Dai, Novi, MI (US)

(72) Inventor: David Dai, Novi, MI (US)

(73) Assignee: Pittsburgh Glass Works, LLC, Pittsburgh, PA (US)

( * ) Notice: Subject to any disclaimer, the term of this patent is extended or adjusted under 35 U.S.C. 154(b) by 84 days.

(21) Appl. No.: 15/951,363

(22) Filed: Apr. 12, 2018

(65) Prior Publication Data

US 2019/0319333 A1 Oct. 17, 2019

(51) Int. Cl.
*H01Q 1/12* (2006.01)
*H01Q 13/10* (2006.01)

(52) U.S. Cl.
CPC ..... *H01Q 1/1271* (2013.01); *H01Q 13/10* (2013.01)

(58) Field of Classification Search
CPC ..... H01Q 1/1271
See application file for complete search history.

(56) References Cited

U.S. PATENT DOCUMENTS 5,355,144 A * 10/1994 Walton ..... B32B 17/10036 343/713
5,610,618 A * 3/1997 Adrian ..... H01Q 1/1271 343/711
5,898,407 A * 4/1999 Paulus ..... B32B 17/10 343/713
6,147,654 A * 11/2000 Nagy ..... H01Q 1/1278 343/704
6,191,746 B1 * 2/2001 Nagy ..... H01Q 1/1271 343/711
6,211,832 B1 * 4/2001 Endo ..... H01Q 1/1278 343/704
6,292,149 B1 * 9/2001 Endo ..... H01Q 1/1278 343/711
6,448,935 B2 * 9/2002 Fuchs ..... H01Q 1/1278 343/704
6,937,198 B2 * 8/2005 Iijima ..... H01Q 1/1278 343/704
7,106,262 B2 * 9/2006 Baranski ..... H01Q 1/1278 343/713
7,847,745 B2 * 12/2010 Martin ..... B32B 17/10036 343/711
8,466,842 B2 * 6/2013 Dai ..... H01Q 13/10 343/712
8,576,130 B2 * 11/2013 Dai ..... H01Q 1/1278 343/713

(Continued)

*Primary Examiner* — Ab Salam Alkassim, Jr.
(74) *Attorney, Agent, or Firm* — Dentons Cohen & Grigsby P.C.

(57) ABSTRACT

A slot antenna in a vehicle glazing established between the surface of the vehicle portal for the glazing and the peripheral edge of an IR reflective coating that has a bus bar over the coating edge. The antenna slot is fed directly by a voltage probe and/or a conductive line located in the slot and parallel to the bus bar. Multiple voltage probes and conductive lines can support respective antennas. A second conductive line is parallel and cooperates with the first conductive line to form a coupled coplanar line that links to the antenna slot. The longitudinal location of the links and the length of the coplanar lines are adjusted to excite multiple frequency modes. Multiple antennas can be used to broaden overall bandwidth or to add additional frequency modes.

20 Claims, 8 Drawing Sheets

(56) References Cited

U.S. PATENT DOCUMENTS

| | | | | |
|---|---|---|---|---|
| 8,836,592 | B2 * | 9/2014 | Paulus | H01Q 13/10 343/713 |
| 9,337,525 | B2 * | 5/2016 | Dai | H01Q 13/10 |
| 9,350,071 | B2 * | 5/2016 | Kobayashi | H01Q 1/1271 |
| 9,564,674 | B2 * | 2/2017 | Dai | H01Q 1/1271 |
| 9,653,792 | B2 * | 5/2017 | Dai | H01Q 21/50 |
| 9,837,699 | B2 * | 12/2017 | Dai | H01Q 1/1271 |
| 10,297,897 | B2 * | 5/2019 | Hashimoto | B60J 1/00 |
| 10,811,760 | B2 * | 10/2020 | Dai | H01Q 5/35 |
| 10,847,867 | B2 * | 11/2020 | Dai | H01Q 13/10 |
| 2005/0035913 | A1 * | 2/2005 | Baranski | H01Q 1/1278 343/713 |
| 2005/0128153 | A1 * | 6/2005 | Doi | H01Q 1/1271 343/713 |
| 2012/0098715 | A1 * | 4/2012 | Dai | H01Q 1/1278 343/712 |
| 2012/0098716 | A1 * | 4/2012 | Dai | H01Q 1/1271 343/713 |
| 2013/0113664 | A1 * | 5/2013 | Kobayashi | H01Q 1/1271 343/711 |
| 2015/0222006 | A1 * | 8/2015 | Dai | H01Q 1/1271 343/712 |
| 2015/0222010 | A1 * | 8/2015 | Dai | H01Q 21/50 343/713 |
| 2015/0222242 | A1 * | 8/2015 | Dai | H01Q 1/1271 333/33 |
| 2016/0006112 | A1 * | 1/2016 | Kagaya | H01Q 1/1285 343/712 |
| 2017/0040662 | A1 * | 2/2017 | Dai | H01Q 1/1271 |
| 2018/0090811 | A1 * | 3/2018 | Kagaya | H01Q 9/30 |
| 2018/0151939 | A1 * | 5/2018 | Hashimoto | B60J 1/00 |
| 2019/0273302 | A1 * | 9/2019 | Dai | H01Q 25/30 |
| 2019/0319334 | A1 * | 10/2019 | Dai | H01Q 1/1271 |

* cited by examiner

HIDDEN MULTI-BAND WINDOW ANTENNA

TECHNICAL FIELD

Field of the Invention

The present invention relates generally to vehicle antennas and, more particularly, to antennas formed in association with a glazing having an electrically conductive coating.

BACKGROUND OF THE INVENTION

Discussion of the Prior Art

In the prior art, as an alternative to standard whip antennas and roof mount mast antennas, automotive antennas have been concealed in the glazing. In some cases, such antennas have been made by silver printing techniques. More recently, embedded wire antennas of quarter or half wavelength have been used in laminated windshields and back windows. In such glazings, a wire is embedded in an interlayer of polyvinyl butyral that is sandwiched between a pair of glass sheets.

Many wire antenna designs known in the prior art have located the antenna wire in the daylight opening of the windshield or glass window for better performance. In the case of a convertible vehicle, the back window is movable and therefore placement of an antenna therein is generally not feasible. In such cases, space for placing antennas in the glazing is at a premium. This difficulty is compounded by an increasing demand for multiple antennas in the windshield. However, the use of such multiple antennas in the daylight portion of a windshield tends to detract from the aesthetics of the vehicle and may even interfere with visibility through the windshield.

Previously, vehicle glazings that employ a metallic coating to limit infrared radiation through the glazing have utilized a spacing at the perimeter of the metallic coating to create a slot antenna in the glazing. Since such slot antennas are formed at the perimeter of the metallic coating and near the metal frame, they can be concealed behind an opaque band at the perimeter of the glazing.

In some cases window antennas employ a theory of operation that uses a quarter-wavelength or half-wavelength antenna in combination with a vehicle window having a thin IR reflective film or conductive coating on or between the layers of the glass window. For example, U.S. Pat. Nos. 4,849,766; 4,768,037; and 4,864,316 illustrate a variety of antenna shapes that are formed by a thin film on a vehicle window. U.S. Pat. No. 5,670,966 discloses an automotive antenna having several electrically interconnected coating regions. U.S. Pat. Nos. 5,083,135 and 5,528,314 illustrate a vehicle antenna having a transparent coating in the shape of a "T". U.S. Pat. No. 6,448,935 discloses an antenna having a two-piece conductive coating that is used as AM and FM antennas that are separated to reduce AM noise and improve system performance.

Other designs include a slot antenna that is formed between the metal frame of a window and a conductive transparent film or coating that is bonded to the window wherein an outer peripheral edge of the transparent film is spaced from the inner edge of the window frame to define a slot antenna. Such antennas are illustrated in U.S. Pat. Nos. 4,707,700 and 5,355,144. U.S. Pat. No. 5,898,407 purports to improve transmission and reception of radio frequency waves by use of a conductive coating with at least one edge that overlaps the window frame of the vehicle body to establish a short to ground for coupling of high frequency signals. U.S. Pat. No. 7,764,239 B2 discloses the use of a laser beam to create a slot antenna by removing the conductive coating. Since the antenna feeding cable has to cross the slot, a large space on the window is required to conceal the antenna feed structure, thus restricting the antenna location to the top of the window. U.S. Pat. No. 6,320,276, B1 discloses an antenna feeding structure that uses a capacitive coupling apparatus in which wires are capacitively coupled to the slot antenna.

From an aesthetic point of view, a slot antenna is generally preferred because the antenna is not visible. Thus, the slot antenna has generally broader application, especially for convertible vehicles. Another advantage of slot antennas in comparison to wire antennas is that they afford greater heat load reduction for the vehicle. That is because the slot antenna requires removal of a relatively small area of the heat reflective coating in comparison to many other antenna designs. However, slot antennas also present several technical challenges, especially when used in connection with the vehicle windshield. First, the area around the glazing perimeter for locating the antenna elements is very limited. That limitation has made it difficult to design glazings with multiple antennas that meet typical performance requirements. Secondly, the slot antenna with limited width generally has a narrow bandwidth so that it may not meet requirements for automotive wireless applications. Finally, when multiple antennas are excited from proximate feed positions, mutual coupling between antennas adversely effects antenna performance, especially for diversity applications in the FM, TV and DAB bands.

Therefore, there has been a need to provide an antenna system, particularly a windshield antenna, that is concealed from view and that also has a slot antenna with enhanced bandwidth that supports multiple antennas over separate frequency bands that address different applications.

SUMMARY OF THE INVENTION

The presently disclosed invention discloses a slot antenna that is suitable for use in vehicle applications. The disclosed antenna with a plurality of antenna feed methods has improved impedance matching, frequency tuning capability and improved the bandwidth. The slot antenna affords improved performance in the VHF and UHF bands while also retaining the solar benefits of the heat reflective coating and excellent aesthetics.

The slot antenna is formed between the metal frame of a window and a conductive transparent film or coating that is bonded to the window. The transparent film has an outer peripheral edge that is spaced from the inner edge of the window frame. The slot dimension is designed to support fundamental modes within frequency bands of interest. Preferably, the total slot length is one wavelength for an annular shaped slot or one half-wavelength for non-annular shaped slot for the fundamental excitation mode.

The slot antenna can be excited by a voltage source such as a balanced parallel transmission line that is connected to the opposite edges of the slot or by a coaxial transmission line that is connected to the opposite edges of the slot. The slot antenna may also be fed by a coplanar line probe. Here the inner conductor is extended along the center of the slot forming a coplanar transmission line, effectively giving a capacitive voltage feed. The antenna has a plurality antenna feeds electrically coupled to the slot at multiple positions where each position excites at least one mode of the slot. The antenna feed positions and the combination of feeds to the antenna are selected to provide a diversity antenna system with enhanced bandwidth and that meets wireless communication requirements.

The IR reflective coatings have one or more layers of silver and typically have a sheet resistance of about 3 Ω/□ for an optical transmission of about 75%. Electrical currents that flow on the coating surface result in resistance losses that impair antenna performance. To increase antenna efficiency, a bus bar such as silver or copper is printed onto the surface of the glazing near the edge of the slot antenna and is electrically connected to the conductive IR coating. The electrical conductivity of the bus bar is high relative to the conductive coating such that the slot antenna is defined by the edge of the conductive coating, the bus bar and the edge of the window frame. Most of the electrical current flows and concentrates on the high conductive bus bar so that resistance loss is relatively low. The increased conductivity in the current flow path also increases antenna radiation efficiency.

The coplanar line feed method not only provides a convenient antenna feed at any point around the perimeter of the window slot, but also affords opportunity for combination of feeds for wideband or multiple band applications. Each mode of the slot has a different field distribution with maxim points at different locations. A circuit of combined feeds can excite multiple modes of a single antenna to either improve the bandwidth or afford multiband applications. When combining two feed lines of different modes together, both signals are in phase so that they do not tend to cancel each other and, in addition, provide minimal loading to other modes. Two different feeding techniques are described in detail.

BRIEF DESCRIPTION OF THE DRAWINGS

For a more complete understanding of the disclosed invention, reference is made to the embodiments illustrated in greater detail in the accompanying drawings and described below by way of examples of the invention. In the drawings.

DETAILED DESCRIPTION OF THE INVENTION

Figure 1:
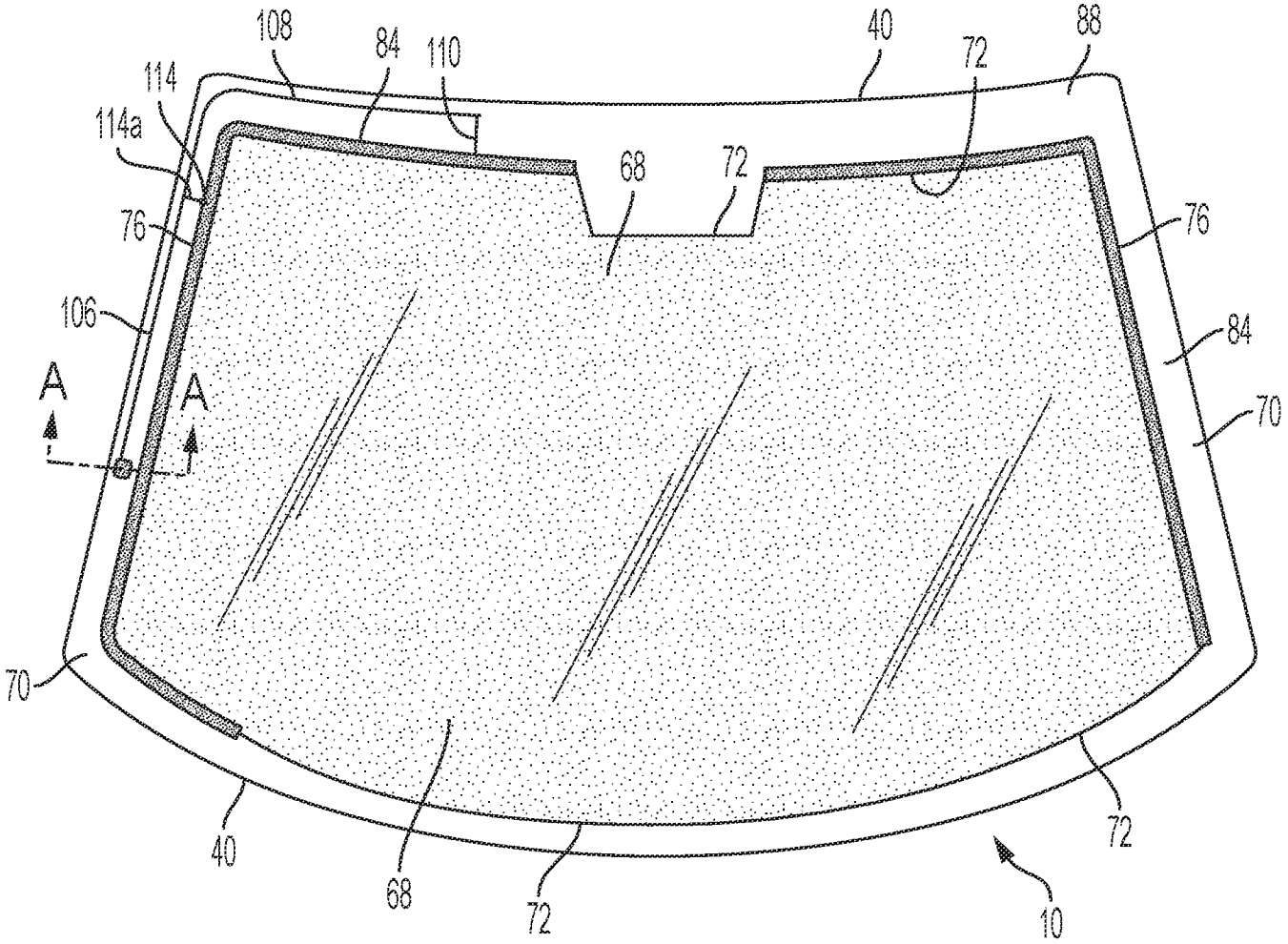
FIG. 1 is a plan view of a transparent glazing with portions of the glazing removed to better disclose features of the presently disclosed invention.
Figure 2A:
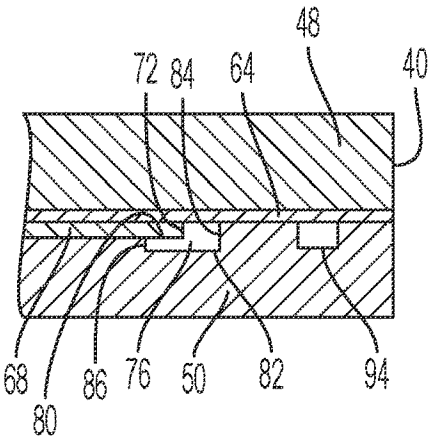
FIG. 2 is sectional view taken along line A-A in FIG. 1 and includes the portions of the glazing that are removed from FIG. 1.
Figure 2:
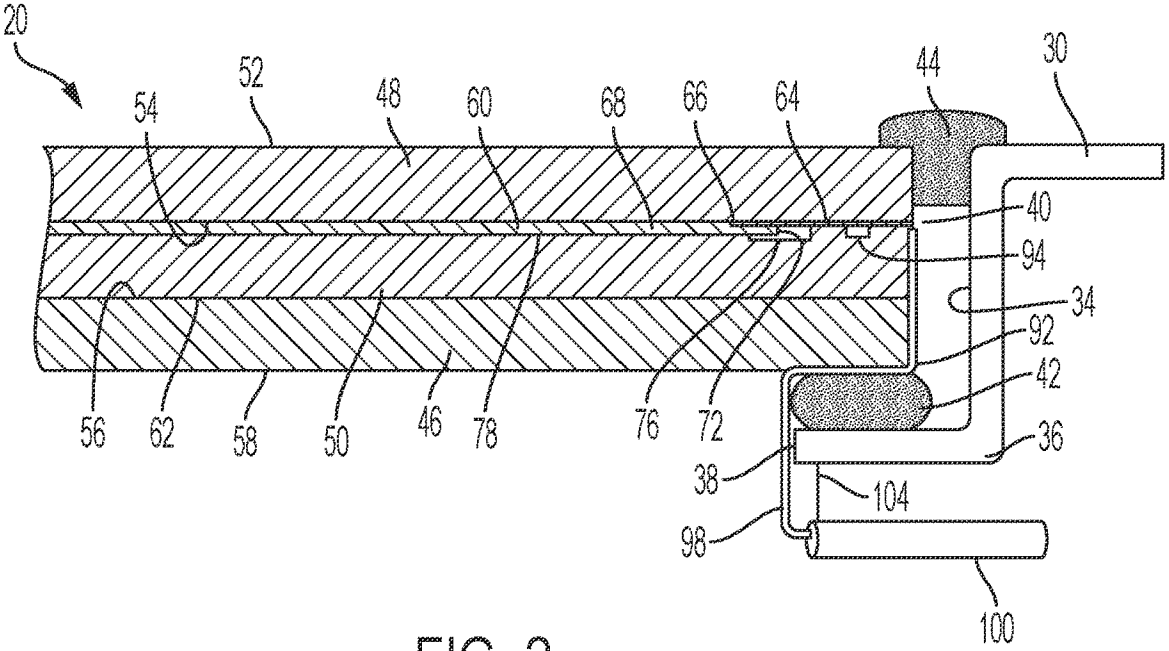

FIGS. 1 and 2 disclose an antenna windshield 10 for use in a vehicle, including associated structure that incorporates features of the presently disclosed invention. In FIGS. 1 and 2, a glazing 20 is surrounded by a metal frame 30 of a vehicle body. Frame 30 defines a surface 34 that forms a portal for receiving glazing 20. The portal surface 34 includes the surface of an annular flange 36 that has an edge 38. Glazing 20 defines an outer perimeter edge 40 that overlaps annular flange 36. As particularly shown in FIG. 2, an annular seal 42 is located between perimeter edge 40 of window glazing 20 and annular flange 36. A molding 44 bridges an outer gap between annular flange 36 and glazing 20.

In the embodiment of FIGS. 1 and 2, glazing 20 is a laminated glazing that includes inner transparent ply 46 and outer transparent ply 48 that may be composed of glass. Inner ply 46 and outer ply 48 are bonded together by an interlayer layer 50. Preferably, interlayer 50 is made of a polyvinylbutyral or similar material. Outer ply 48 has an outer surface 52 (conventionally referred to as the number 1 surface) that defines the outside of glazing 20 and an inner surface 54 (conventionally referred to as the number 2 surface). Inner surface 54 is oppositely disposed on outer ply 48 from outer surface 52. Inner ply 46 has an outer surface 56 (conventionally referred to as the number 3 surface) that faces internally on glazing 20 and an inner surface 58 (conventionally referred to as the number 4 surface) that defines the inside of glazing 20 and faces internally to the vehicle. Interlayer 50 defines an outer surface 60 that faces surface 54 of outer ply 48 and an inner surface 62 that is oppositely disposed on interlayer 50 from outer surface 60 and that faces surface 56 of inner ply 46.

As shown in FIG. 2, glazing 20 may include a concealment band 64 such as a paint band that is applied to outer ply 48 by screen printing opaque ink around the perimeter of surface 54 of outer ply 48 and then firing the perimeter of the outer ply. Concealment band 64 has a closed inner edge 66 that defines the boundary of the daylight opening (DLO) of glazing 20. Concealment band 64 is sufficiently wide to cover the antenna elements of the disclosed windshield as well as other apparatus that is included near the outer perimeter of glazing 20 as hereinafter shown and described.

Glazing 20 further includes an electro-conductive coating 68 that covers the daylight opening of glazing 20. Electro-conductive coating 68 reflects incident infrared solar radiation to provide a solar shield for the vehicle on which glazing 20 is used. Coating 68 reduces transmission of infrared and ultraviolet radiation through the glazing. Preferably, coating 68 is a semi-transparent electro-conductive coating that is applied on surface 54 of outer ply 48 (as shown in FIG. 2) or on surface 56 of inner ply 46 in accordance with processes well known in the art. Coating 68 is electrically conductive and may have single or multiple layers of metal-containing coating as, for example, disclosed in U.S. Pat. No. 3,655,545 to Gillery et al.; U.S. Pat. No. 3,962,488 to Gillery and U.S. Pat. No. 4,898,789 to Finley. Typically, coating 68 has a sheet resistance of about 3Ω/□ and an optical transmission of about 75%.

A band of coating 68 is removed from surface 54 of outer ply 48 between outer perimeter 40 of glazing 20 and a deletion edge 72 of coating 68 to form a band 70. Coating 68 may be removed from glazing 20 either by mask deletion or laser deletion techniques. Removal of coating 68 in this way helps to prevent corrosion at the perimeter of coating 68 and helps to avoid undesired radio frequency coupling to the window frame. Deletion edge 72 is laterally located on glazing 20 between the inner edge 66 of band 64 and perimeter edge 40 of glazing 20. Removal of coating 68 in this way provides the basic structure of an antenna slot.

A high conductive bus bar 76 is screen printed onto surface 54 of outer ply 48 and surface 78 of coating 68 such that bus bar 76 covers a longitudinal segment of deletion edge 72 of conductive coating 68. Bus bar 76 overlays a portion of outer ply 48 that is adjacent deletion edge 72 and also overlays a portion of coating 68 that is adjacent deletion edge 72 such that bus bar 76 overlays a longitudinal segment of deletion edge 72. Within the segment of deletion edge 72 that bus bar 76 overlays, bus bar 76 also overlays the surface of band 70 that is laterally adjacent deletion edge 72 of coating 68. In this way, bus bar 76 forms a metal strip that is electrically connected to coating 68 with a surface 80 of bus bar 76 contacting coating 68 and band 64.

In an alternative embodiment, band 64 can be located on outer surface 56 of inner ply 46. In that embodiment, bus bar 76 overlays a segment of deletion edge 72 and also overlays surface 54 of outer ply 48 that is laterally adjacent deletion edge 72 of coating 68.

In the assembled glazing 20, bus bar 76 also defines a surface 82 that is oppositely disposed from surface 80 with surface 82 facing and in contact with surface 60 of interlayer 50. An edge surface 84 defines the surface of bus bar 76 between surfaces 80 and 82. Bus bar 76 has greater electrical conductivity than the electrical conductivity of electrically conductive coating 68. Deletion edge 72 defines the outer peripheral edge of coating 68. Edge surface 84 of bus bar 76 is laterally spaced in glazing 20 between deletion edge 72 (i.e. the outer peripheral edge) of electrically conductive coating 68 and perimeter edge 40 of glazing 20. Edge surface 84 of bus bar 76 is also laterally spaced between deletion edge 72 and portal surface 34 of frame 30. Bus bar 76 also defines an edge 86 between surfaces 80 and 82 that is oppositely disposed on bus bar 76 from edge 84. Edge 86 of bus bar 76 is spaced apart from and inwardly on glazing 20 from outer peripheral edge 72 of electrically conductive coating 68 such that bus bar 76 covers a longitudinal segment (in the shape of a strip) of electrically conductive coating 68 along edge 72 and at least partially overlaps outer peripheral edge 72 of electrically conductive coating 68. Bus bar 76 cooperates with the portal surface 34 of metal frame 30 and with electrically conductive coating 68 to define a slot antenna between first edge 84 of bus bar 76 and portal surface 34.

Glazing 20 (including bus bar 76, and portal surface 34) defines an antenna slot 88 between portal surface 34 on one side of slot 88 and edge surface 84 of bus bar 76 in combination with deletion edge 72 on the side of slot 88 that is opposite from portal surface 34. To avoid shorting the signal across slot 88, the slot width must be sufficiently large that the capacitive effects across the slot at the frequency of operation are negligible. The slot width is preferably greater than 10 mm. The preferred longitudinal dimension of the slot is an integer multiple of the wavelength at the desired resonance frequency if the slot is annular and an integer multiple of one half of the wavelength at the desired resonance frequency if the slot is not annular. For a windshield on a typical passenger vehicle, the slot length is selected to that the signal will resonate at the VHF band so that the signal also can be used for the TV VHF band as well as FM applications.

Figure 4:
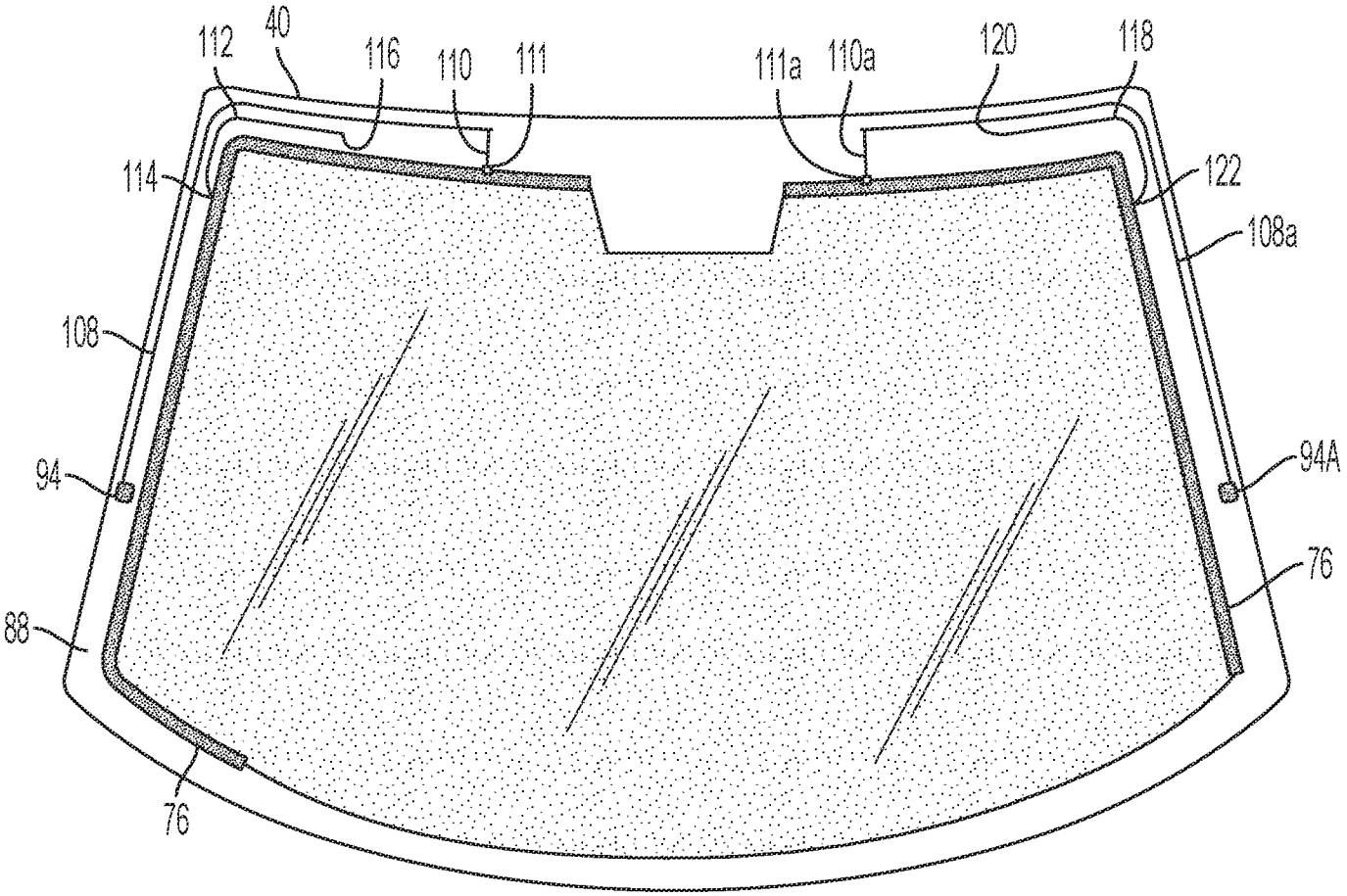
FIG. 4 is a plan view of a glazing that incorporates additional features of the presently disclosed invention.
Figure 5:
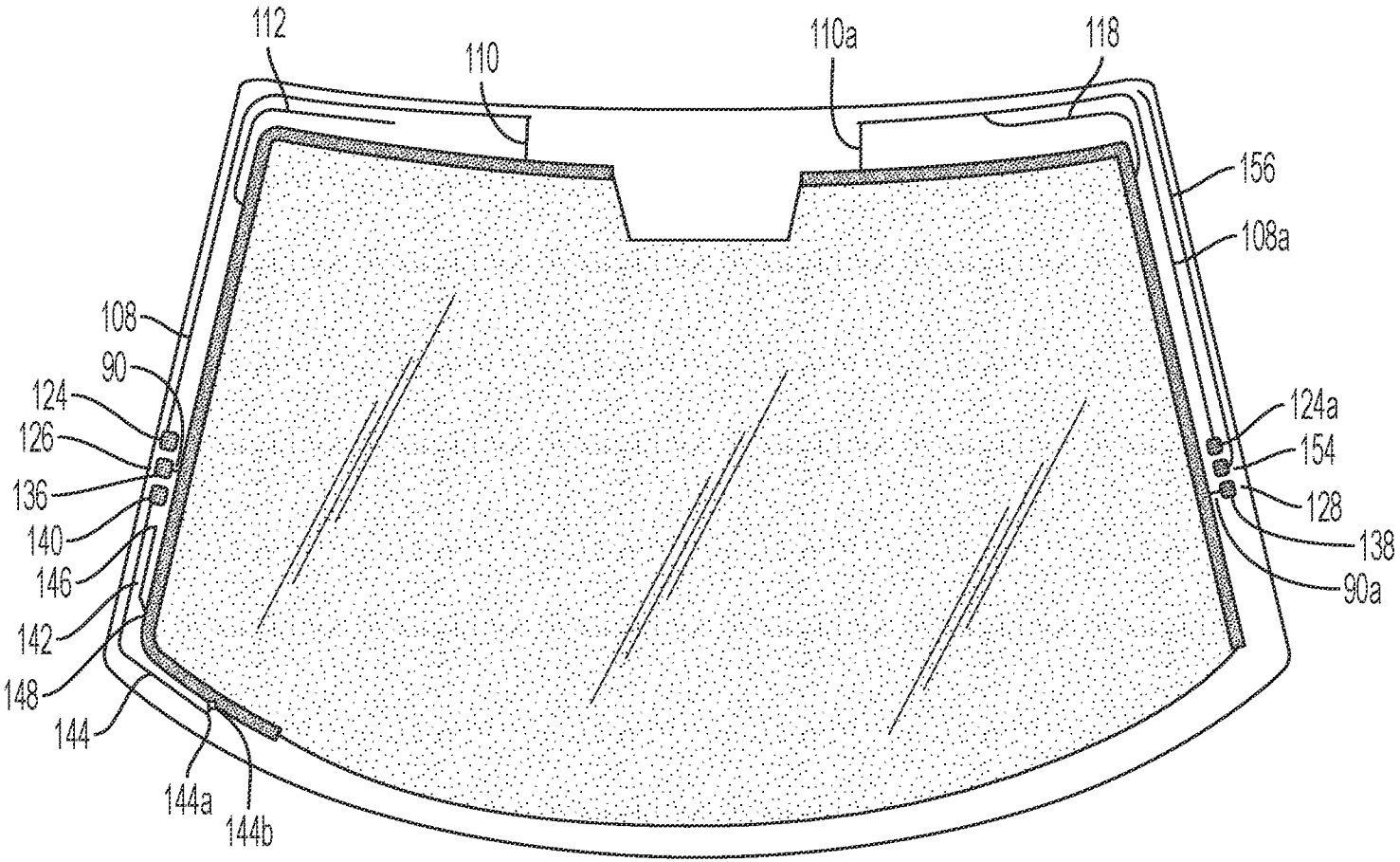
FIG. 5 is a plan view of transparent glazing with six separate antennas that provide pattern diversity and multiple band performance.

FIGS. 4 and 5 illustrate that slot 88 can be excited by several different types of voltage sources. For example, a voltage source may be a balanced parallel transmission line that is connected to the opposite edges of the slot. As another example, the voltage source may be a coaxial transmission line that is electrically connected to the opposite sides of the slot. In the example of a preferred embodiment shown in FIGS. 2 and 5, a voltage probe that directly feeds the slot antenna includes an antenna feed line 90 that is orthogonal to slot 88. Antenna feed line 90 is connected to bus bar 76 from the outer perimeter edge 40 of glazing 20 to establish the feed point for annular slot 88. When an excitation signal is fed to annular slot 88 in this way, the feed voltage for the antenna is equal to the aperture field voltage of the slot antenna at the longitudinal position in annular slot 88 where antenna feed line 90 is connected to bus bar 76.

As illustrated in FIG. 2, a copper foil 92 is conductively connected to a solder patch 94 and solder patch 94 is connected to one end of feed line 90. Feed line 90 is a conductive line screen printed onto surface 54 of outer ply 48. Copper foil 92 exits from outer perimeter edge 40 of glazing 20, folds back around the peripheral edges of interlayer 50 and inner ply 46, and is sandwiched between inner surface 58 of inner ply 46 and annular seal 42. Copper foil 92 is conductively connected to a center conductor 98 of a coaxial transmission line 100. Preferably, copper foil 92 is covered by plastic tape or other electrical insulation so that it is electrically isolated from portal surface 34 and does not short out the radio frequency signals at locations where it passes portal surface 34 and annular seal 42. Annular slot 88 is grounded to portal surface 34 of flange 36 through a cable ground wire 104. Ground wire 104 is connected to flange 36 of the vehicle frame near portal surface 34. In an active antenna system, center conductor 98 is connected to an amplifier (not shown) that is also grounded to the vehicle frame.

Figure 3:
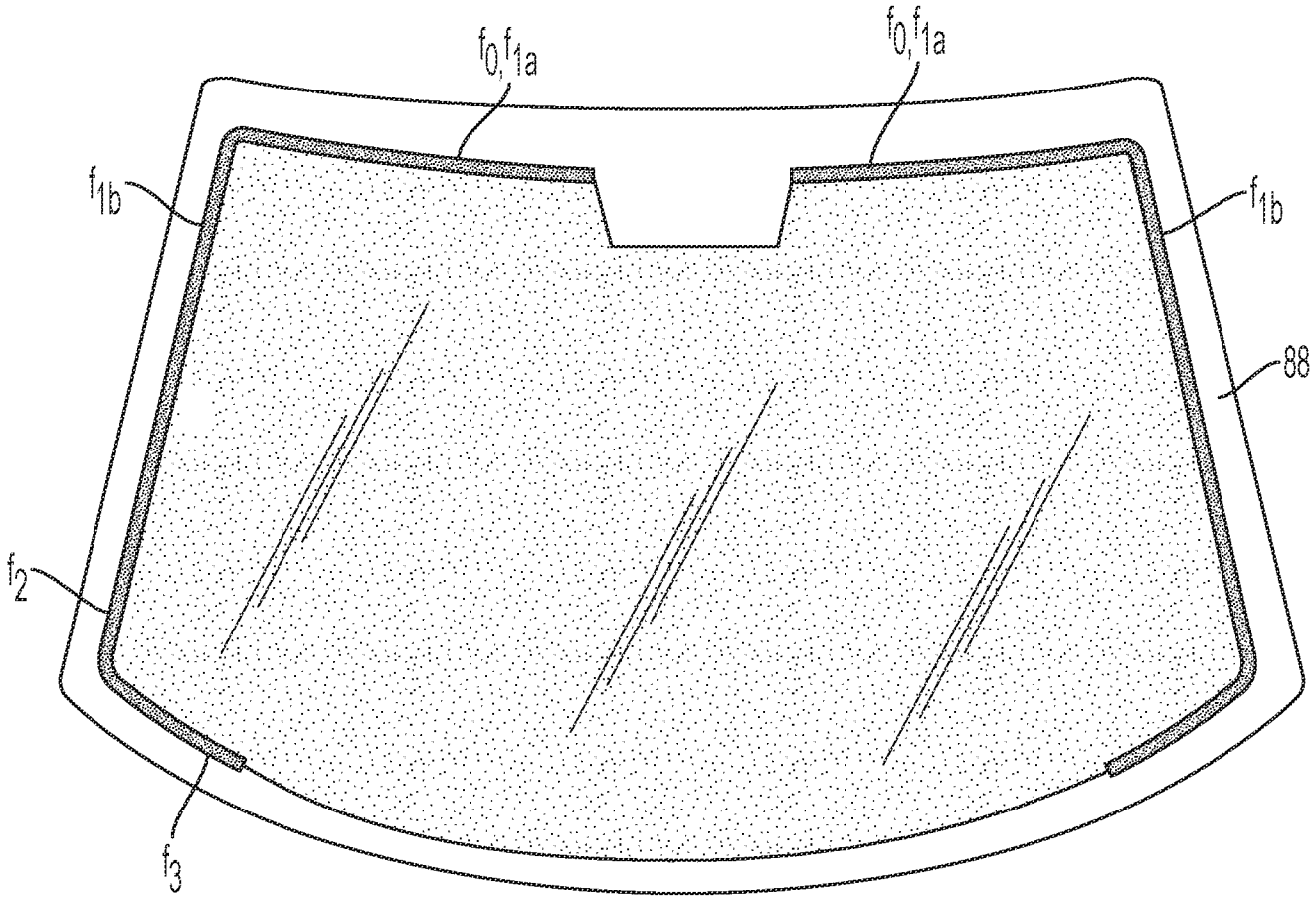
FIG. 3 is an exemplary diagram of the distribution of electrical fields in the antenna of FIG. 1 for a fundamental mode, its first order mode, its second order mode, its third order mode, and its fourth order mode.

As discussed in connection with FIG. 3, in the preferred embodiment, annular slot 88 resonates not only in a fundamental mode (defined as the fundamental frequency of the excitation signal), but annular slot 88 also resonates in higher order modes (defined as frequencies higher than the fundamental frequency at which annular slot 88 or portions thereof will also resonate. Each resonance mode establishes a respective field distribution in which the strength of the electric field alternates between maximum and minimum strengths at successive longitudinal positions along annular slot 88. To excite a resonate mode of annular slot 88, the voltage source is connected to bus bar 76 at a longitudinal position of slot 88 where a maximum electric field for that resonance frequency is located. FIG. 3 illustrates the distribution of fields along annular slot 88 that is shown in FIG. 1. FIG. 3 illustrates frequency $f_0$ (fundamental mode), $f_1$ (first higher mode), $f_2$ (second higher mode), $f_3$ (third higher mode) and $f_4$ (forth higher mode). For a windshield of a typical passenger sedan, the longitudinal dimension of an annular slot is such that it may conveniently support four modes: $f_0$ at FM frequency (100 MHz), $f_1$ at digital audio broadcasting (DAB) frequency (200 MHz), $f_3$ at RKE US/Japan frequency (315 MHz) and $f_4$ at RKE Europe frequency (434 MHz). At higher frequencies such as UHF frequencies, the corresponding signal wavelength is shorter so that annular slot 88 behaves similarly to a longer slot at lower frequencies. This means that at higher frequencies, the same annular slot 88 can be excited at more than one resonance mode. Furthermore, the excitation signal can be fed to annular slot 88 at various longitudinal positions along the slot. When the longitudinal locations within annular slot 88 for different resonance mode feeds are one quarter wavelength apart, the respective signals will not interfere with each other. In this way, annular slot 88 is capable of supporting a plurality of frequency modes with each mode capable of a unique antenna pattern to produce an antenna with a diversity of antenna patterns over a range of antenna modes.

The longitudinal position where maximum and minimum field distributions occur for each respective resonance mode may vary in accordance with the geometry of the particular portal surface 34 for that vehicle, the shape and orientation of the electrically conductive coating 68 with respect to the vehicle body, the antenna feed location, and the proximity of other wire harness layouts that are connected to the glazing and that may be used for other functions such as wiper heating and window defrosting.

As an alternative to the direct feed structure for slot 88 that is described herein in connection with FIGS. 2 and 5, FIG. 1 shows that annular slot 88 may also be fed by a coplanar transmission line 106. Coplanar transmission line 106 is formed by a thin conductive line 108 that is laterally located in annular slot 88 half-way between portal surface 34 of the frame and edge surface 84 of bus bar 76. Conductive line 108 is oriented in the longitudinal dimension parallel to edge surface 84 of bus bar 76. In the example of FIG. 1, conductive line 108 is connected to bus bar 76 at a longitudinal position of annular slot 88 that is located near the top of glazing 20 through an electrically conductive feed link 110. In the example of FIG. 1, feed link 110 is oriented vertically. The longitudinal position of the connection of feed link 110 to bus bar 76 defines the antenna feed point 111. Line 108 in cooperation with conductive coating 68, bus bar 76, and portal surface 34 form a coplanar line. Bus bar 76, which is highly conductive relative to the conductivity of coating 68, is connected to edge 72 of coating 68 to increase electrical conductivity of annular slot 88 and reduce ohm losses occasioned by the relatively high sheet resistance of coating 68.

Referring to FIGS. 1 and 3 together, excitation of annular slot 88 at the feed point 111 shown in FIG. 1 can result in excitation of the slot antenna in at least two modes—$f_0$ (fundamental mode) at FM frequency and $f_{1a}$ (first higher order resonance mode) at DAB frequency. This is a particular case of a multiband antenna in which two bands are propagated from a single feed point. This is owing to the fact that (for this illustration) the longitudinal position of the $f_0$ feed point (position of maximum electric field strength at the fundamental frequency) coincides with the longitudinal location of the $f_{1a}$ feed point (position of maximum electric field strength at the first higher order resonance frequency). However, the excitation of antenna slot 88 at the $f_0/f_1$ feed point 111 location for feed link 110 shown in FIG. 1 is not sufficient to cover the entire FM/DAB band. That is because the DAB ("digital audio broadcast) employs wide-bandwidth technology that requires the slot antenna to cover frequency band III between 174 MHz to 240 MHz.

Slot antennas applied to automotive glazings as known in the prior art have had relatively narrow bandwidth due to physical limitations on the width of the antenna slot imposed by the vehicle dimensions. To increase antenna bandwidth, the presently disclosed slot antenna provides a DAB frequency at an additional first higher resonance mode ($f_{1b}$) through feed link 114*a* to feed point 114. The $f_0/f_{1a}/f_{1b}$ combination of bandwidths covers the entire FM/DAB band, including frequency band III. The location for the feed point 114 for the additional first higher resonance mode ($f_{1b}$) is also illustrated in FIG. 3. FIG. 3 shows an additional first higher resonance mode ($f_{1b}$) that is one-quarter wavelength from the first feed point $f_0$ 111 at DAB frequency. A feed link 112 from conductive line 108 to the feed point 114 for the additional first higher resonance mode ($f_{1b}$) causes annular slot 88 to resonate at the DAB lower band while the first feed point $f_0/f_{1a}$ 111 at feed link 110 can be tuned so that the first higher order resonance mode ($f_{1a}$) covers the higher band in the DAB range.

FIG. 4 further illustrates how the disclosed slot antenna may use multiple feed techniques to excite three modes: fundamental mode $f_0$, first higher order mode $f_{1a}$, an additional first higher order mode $f_{1b}$. The top left portion of FIG. 4 shows a second feed link 112 that is used to excite the additional first higher order mode $f_{1b}$. The total length of feed link 112 is one-quarter wavelength at the DAB frequency. Feed link 112 is physically aligned in parallel with conductive line 108. Feed link 112 cooperates with conductive line 108 and portal surface 34 of the frame to form a coupled transmission line. Feed link 112 has one end that is connected to bus bar 76 at feed point 114, the position of the additional first higher order mode fib, and an opposite end that is an open, distil end 116. Feed link 112 transfers a low impedance to conductive line 108 at the location of feed point 114 for the additional first higher order mode $f_{1b}$ to electrically connect both conductive line 108 and feed link 112 to bus bar 76 at feed point 114 for the additional first higher order mode $f_{1b}$. Feed link 112 is connected to bus bar 76 at the longitudinal position of annular slot 88 where the electric field for the additional first higher order mode $f_{1b}$ is at a maximum. Thus, only the additional first higher order mode $f_{1b}$ is excited through feed link 112 and feed link 112 does not load conductive line 108 with other frequency modes so as to cause the bandwidth of the antenna to vary from a specified bandwidth.

The frequency band that is contributed by feed link 112 can be tuned by adjusting the length of feed link 112. Also, the frequency bands of the $f_0/f_{1a}/f_{1b}$ combination can be tuned by adjusting the longitudinal position of the two feed points 111 and 114 for $f_0/f_{1a}/f_{1b}$ where feed link 110 and feed link 112 are connected to bus bar 76 so that one resonant mode is established at the lower DAB frequency and a second resonate mode is simultaneously established at the upper DAB frequency. In this way, the antenna feed structure of conductive line 108 and feed links 110 and 112 in FIG. 4 excites at least three resonance modes ($f_0/f_{1a}/f_{1b}$ in combination) to cover the FM and DAB frequency bands.

FIGS. 3 and 4 further illustrate how the second DAB mode also can be excited by a feed link that is directly connected to transmission line 108. In FIG. 4, a second conductive line 108*a* is connected to solder patch 94*a*. Solder patch 94*a* is connected to conductive line 108*a* that has a feed link 110*a* to bus bar 76 at a feed point 11*a* for feeding the fundamental resonance mode ($f_0$) and the first higher order resonance mode $f_{1a}$ as shown in FIG. 3. A second feed link 118 is connected to bus bar 76 at feed point 122 for exciting the additional first higher order mode ($f_{1b}$) as shown in FIG. 3. In FIG. 4, feed link 118 has one end 120 that is connected to conductive line 108*a* and a second end that is connected at feed point 122 to bus bar 76. As shown in FIG. 3, second end of conductive line 108*a* is connected to bus bar 76 at a longitudinal position of annular slot 88 where a second maximum of the electric field at the additional first higher order frequency mode $f_{1b}$ is located. The connection point 120 between feed link 118 and line 108*a* is at a longitudinal position in annular slot 88 where the signal for the first higher order mode $f_{1a}$ (corresponding to the first DAB band) is in-phase with the signal from the additional first higher order mode $f_{1b}$ (corresponding to the second DAB band). In that way the first higher order $f_{1a}$ and additional first higher order $f_{1b}$ signals do not cancel each other when combined to conductive line 108*a*. Also, the feed point 122 of feed link 118 to bus bar 76 is at the longitudinal position of annular slot 88 where the electric field of the additional first higher order resonance mode $f_{1b}$ is at a maximum. At that position, impedance at the $f_0$ and $f_{1a}$ frequencies is high so that link 118 does not load line 108*a* to cause the antenna bandwidth for the $f_0/f_{1a}/f_{1b}$ combination to fall outside the specified bandwidth. To tune the bands at the $f_0/f_{1a}/f_{1b}$ frequencies, the longitudinal positions of feed points 111*a* and 122 where feed links 110*a* and 118 are connected to bus bar 76 can be adjusted longitudinally such that one resonate mode ($f_{1a}$) is at the lower DAB frequency and an additional resonate mode ($f_{1b}$) is at the upper DAB frequency.

FIG. 5 illustrates a coated windshield with 6 antennas. Antennas 124 and 124*a* are fed from a coplanar transmission line such as previously described herein in connection conductive lines 108 and 108*a* and feed links 110, 110*a*, 112 and 118. Antennas 126 and 128 are direct feed antennas such as previously described herein in connection with link 90 in FIGS. 2 and 5. Antenna 126 and antenna 128 are fed directly from respective short lines 90 and 90*a* respectively. Line 90 connects between solder terminal 136 and bus bar 76. Line 90*a* connects between solder terminal 138 and bus bar 76. Antennas 126 and 128 are applicable, for example, as TV antennas that excite high order modes in the UHF frequency band.

Antenna 140 illustrates an RKE antenna that is tuned to two frequencies: RKE for Japan and US at 315 MHz; and RKE for Europe at 434 MHz. Comparing FIGS. 5 and 3 shows that transmission line 144 is connected to bus bar 76 by a feed link 144*a* at a feed point 144*b* location for exciting the third higher resonance mode ($f_3$) at 434 MHz. As illustrated in FIGS. 3 and 5, feed link 142 is connected to bus bar 76 at longitudinal position, feed point 148, in annular slot 88 (illustrated in FIG. 3) for exciting the second higher resonance mode ($f_2$) of the fundamental frequency at 315 MHz. Feed point 148 of feed link 142 is electrically connected to bus bar 76 at the feed point for the second higher order mode ($f_2$)—the longitudinal position of annular slot 88 where the electrical field for the second higher order mode ($f_2$) is at maximum (shown at the lower left side of glazing 20 in FIG. 5). Feed link 142 is physically oriented in parallel with conductive line 144 so that conductive line 144 in combination with feed link 142 and portal surface 34 of frame 30 form a coupled transmission line that electrically couples the second higher resonant signal mode ($f_2$) in annular slot 88 with conductive line 144. The length of feed link 142 between end 146 and feed point 148 is one-quarter wavelength at 315 MHz and the end 146 of feed link 142 that is opposite from feed point 148 of feed link 142 that is connected to bus bar 76 is a distil end that is open. Thus end 146 presents high impedance at one-quarter wavelength at the second higher order mode ($f_2$) and the opposite end at feed point 148 operates as a short that connects antenna conductive line 144 with annular slot 88 at the second higher order mode ($f_2$). Thus, antenna conductive line 144 in combination with feed link 142 and feed link 144*a* excites two frequency modes ($f_2$ and $f_3$) in annular slot 88 that operate as an RKE antenna at 315 MHz and 434 MHz.

Antenna slot 88 also can be fed by a coupled coplanar line shown as antenna 154 in FIG. 5. Antenna 154 includes coplanar feed line 156 that is not directly connected to bus bar 76. Coplanar feed line 156 provides, in effect, a capacitive voltage feed. The feed of coplanar feed line 156 to the antenna slot 88 is a distributed feed that may cross voltage points of the fundamental resonance mode ($f_0$) as well as higher order resonance modes ($f_1$, $f_2$, $f_3$, and $f_4$). Excitation of the higher order modes is desirable for high frequency and multiband antenna applications such as TV antennas or antennas with multiple frequency bands.

Figure 6:
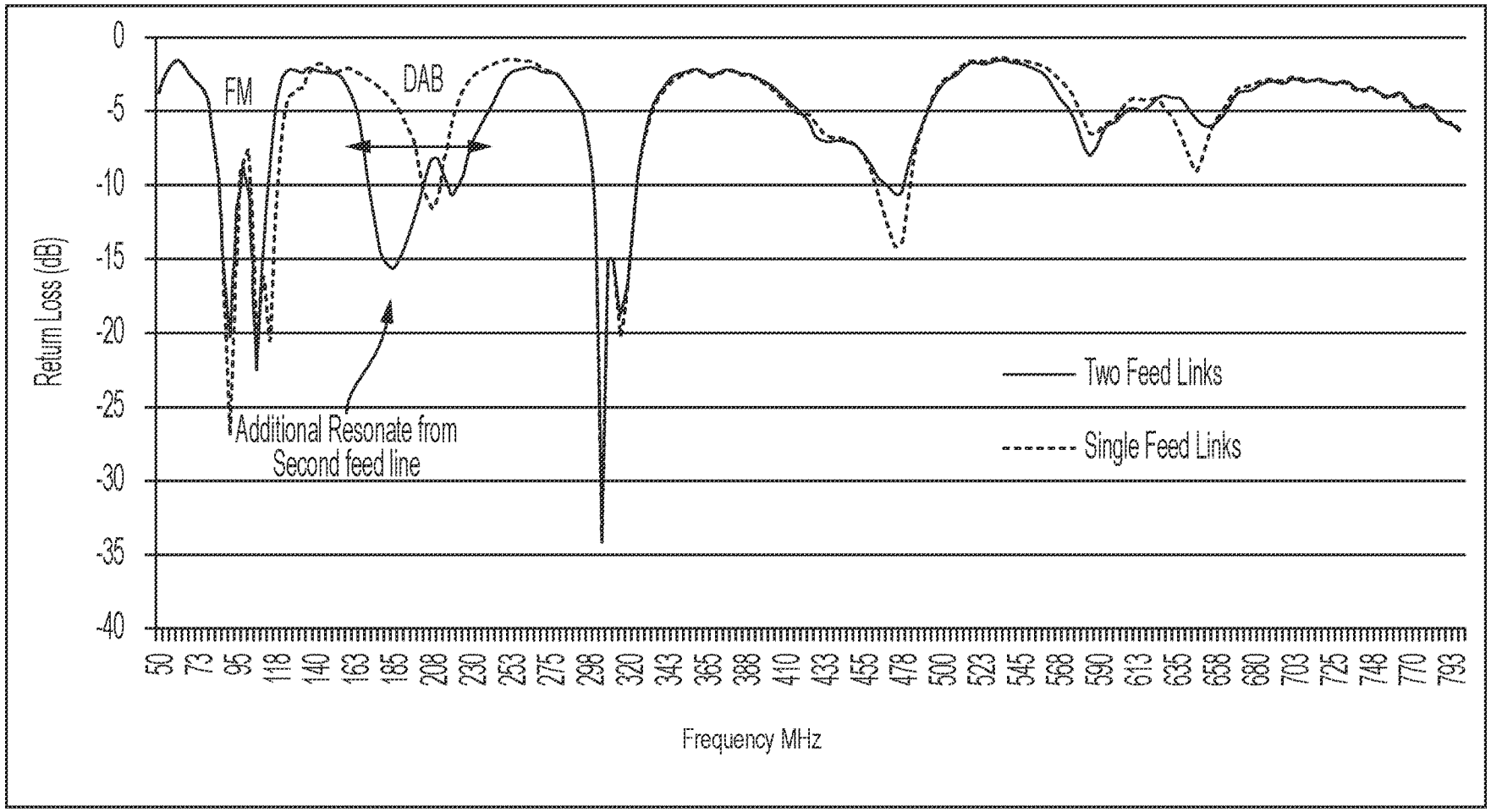
FIG. 6 is a line graph that shows antenna return loss as a function of frequency for antenna 1 of FIG. 5.

An embodiment of the presently disclosed invention similar to that illustrated in FIG. 5 was constructed and tested on a vehicle. FIG. 6 is a plot of the return loss (S11) of the slot antenna configured as antenna 124 in FIG. 5. Return loss S11 is a measure of the power that is delivered to an antenna and reflected from the antenna and the power that is "accepted" by the antenna and radiated. The dotted line curve in FIG. 6 represents the case of antenna 124 with a single feed link 110 connected to the slot antenna. It shows that the fundamental resonance mode ($f_0$) is at FM frequency and that the first higher resonance mode $f_{1a}$ is at DAB frequency. The antenna matching curve in FIG. 6 also shows strong resonance of second higher mode $f_2$ near RKE frequency at 315 MHz and at the third higher resonance mode $f_3$ near RKE frequency at 434 MHz.

FIG. 6 further shows that the slot antenna resonates at DAB frequency with a narrow bandwidth that does not cover the whole DAB band that is required for coverage from 174 MHz to 240 MHz. The solid line curve of FIG. 6 represents the resonant response of antenna 124 in FIG. 5 with the addition of second feed link 112. It shows a strong additional first higher resonance mode at the lower DAB band in addition to the original resonance mode in the upper DAB band from feed link 110. With second feed link 112, the antenna covers the whole DAB band. Both of these cases closely agree over all other frequency bands to indicate that added feed link 112 only excites the additional first higher resonance mode ($f_{1b}$) that is added to the initial first higher resonance mode ($f_{1a}$) in-phase and does not significantly load other modes to the matching curve.

Figure 7:
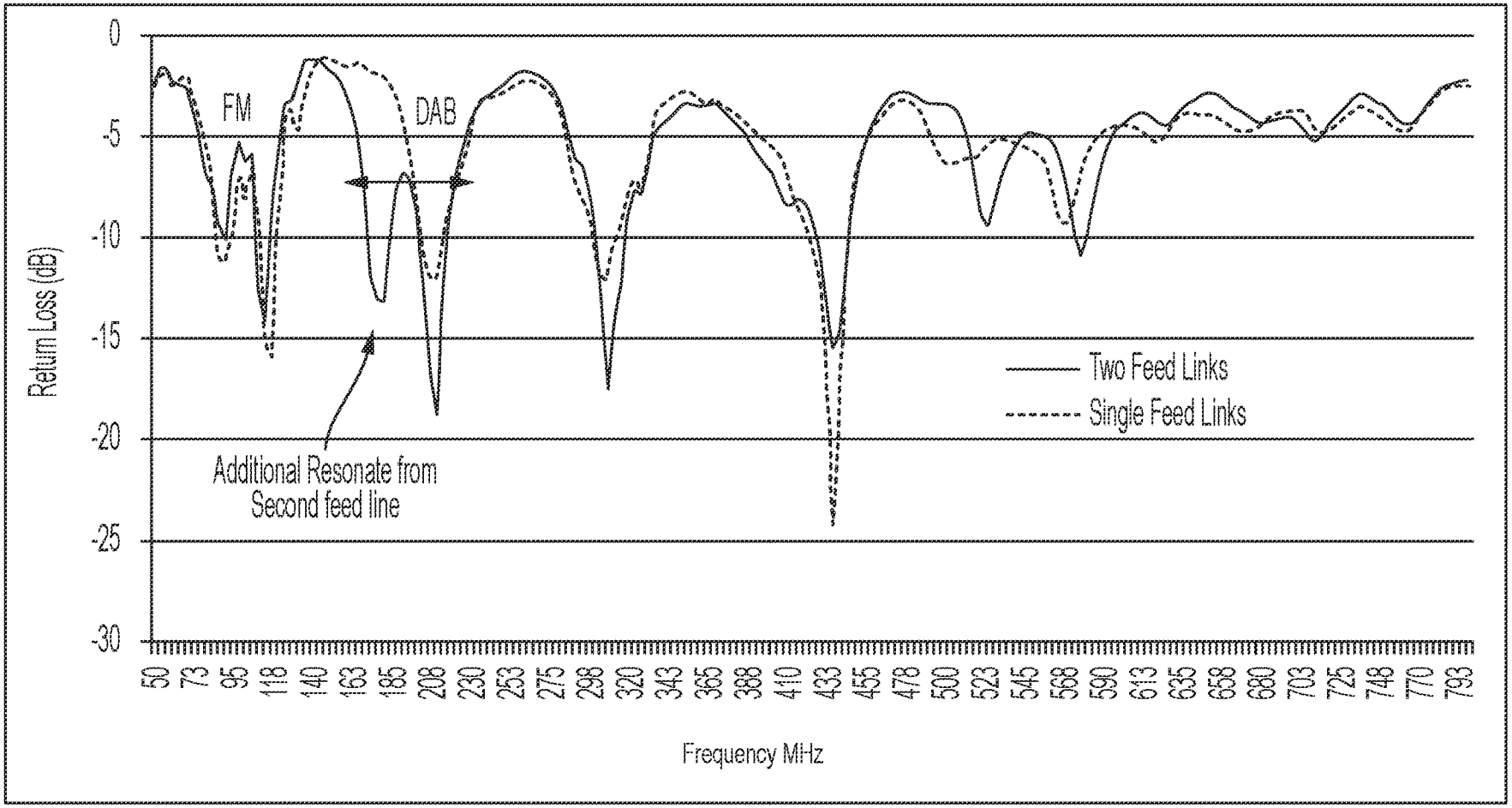
FIG. 7 is a line graph that shows antenna return loss as a function of frequency for antenna 4 of FIG. 5.

FIG. 7 shows a plot of the return loss of the slot antenna 124*a* as illustrated in FIGS. 4 and 5 in which feed link 110*a* and 118 respectively feed antenna slot 88 at two different longitudinal positions. The dotted line curve in FIG. 7 represents the performance of antenna 124*a* when only feed link 110*a* is connected to the slot antenna. It shows that the fundamental resonant mode $f_0$ is at FM frequency and that the first higher resonate mode $f_{1a}$ is at DAB frequency. The antenna matching curve also shows strong resonance at the second higher resonance mode $f_2$ near RKE frequency at 315 MHz and the third higher resonance mode $f_3$ near RKE frequency at 434 MHz. The slot antenna 124*a* with only feed link 110*a* resonates at DAB frequency with a narrow bandwidth that does not cover the whole DAB band that between 174 MHz and 240 MHz.

The solid line curve in FIG. 7 represents the resonate response of antenna 124*a* when the second feed link 118 is added. The solid line curve demonstrates a strong additional resonance at the lower DAB band that is in addition to the band corresponding to the resonance mode in the upper DAB band with only feed link 110*a*. With second feed link 118, antenna 124*a* covers the whole DAB band. Both curves are closely matched over the other frequency bands shown in FIG. 7. This shows that the added feed link 118 only excites an additional first higher mode that combines with the first feed link 110*a* in phase at DAB frequency and does not significantly load other modes that are excited through feed link 110*a*.

Figure 8:
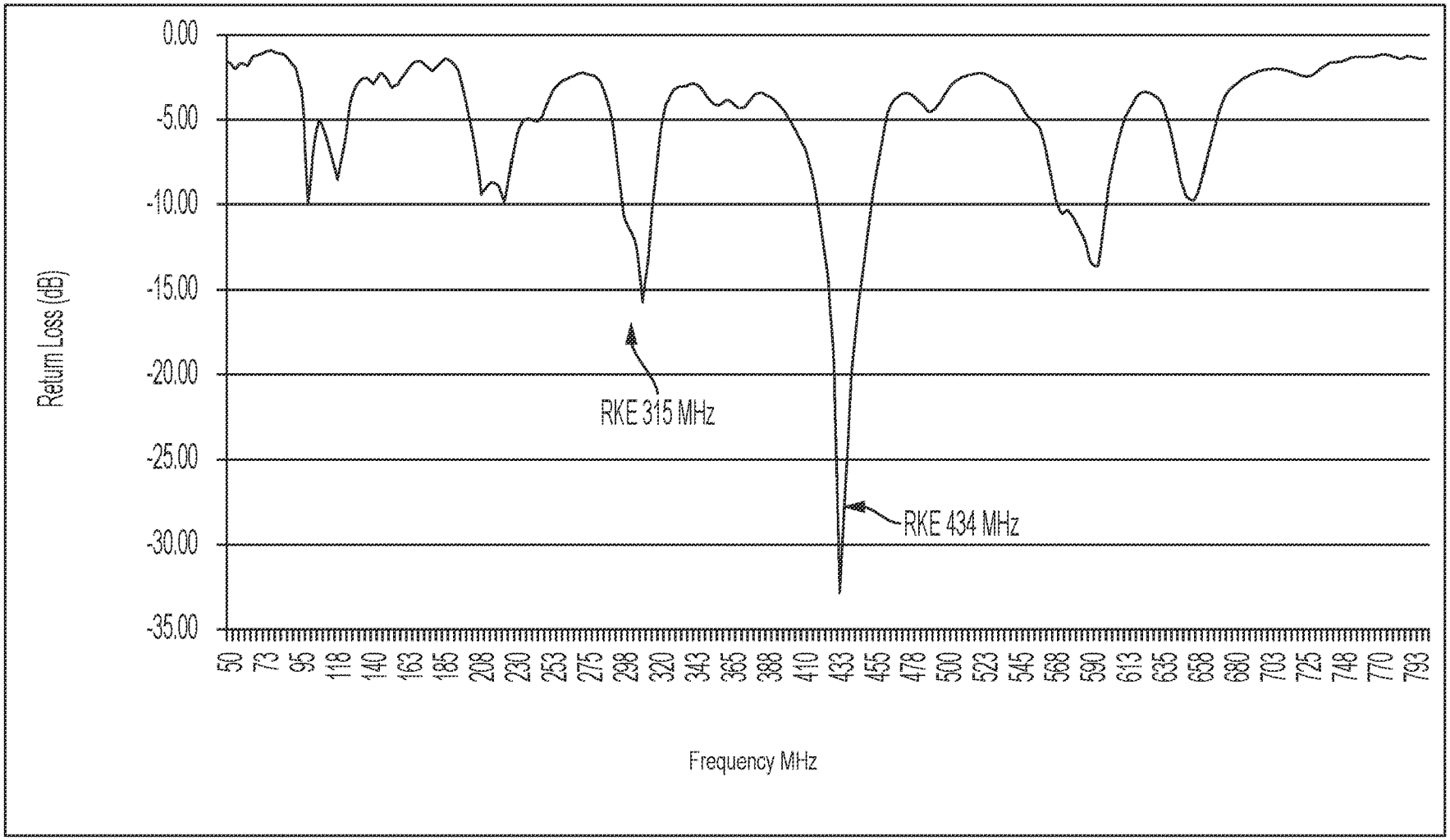
FIG. 8 is a line graph that shows antenna return loss as a function of frequency for antenna 3 of FIG. 5.

FIG. 8 is the plot of the return loss of the antenna 140 that is illustrated in FIG. 5. Similar to the antenna feed of antenna 124, in antenna 140 feed line 142 excites a second higher resonance mode $f_2$ at 315 MHz that is addition to the $f_0$ and $f_{1a}$ modes that are excited through feed link 110. Feed line 142 is one-quarter wavelength in length at 315 MHz and is oriented in parallel relationship with conductive line 144.

The third higher resonance mode $f_3$ is excited by feed link 144*a* through direct connection from conductive line 144 to bus bar 76. The RKE antenna closely matches frequencies at 315 MHz and 434 MHz.

When antenna slot 88 is excited by an electromagnetic wave, the field distribution in the slot can be represented by a set of orthogonal resonate modes. Depending on the longitudinal position of the feed links, a combination of multiple modes resonating at different frequencies can be excited through various types of connections. The fundamental mode with the lowest resonant frequency ($f_0$) can be used for FM and TV VHF band applications and the additional first higher order mode ($f_{1b}$) falls in the TV band III and DAB III band. Higher order resonant modes that are at UHF frequency bands can be used for RKE, TPMS, and TV band 4 and band 5 applications.

It has been found that antenna performance is best for the UHF band when the antenna is fed near the top of the slot antenna. For the VHF band, top feed slot antenna performance is nearly the same as side feed architectures. The electrical current distribution of each antenna resonate mode is different when the antenna is excited at different locations so that the antenna radiation pattern also changes with different antenna geometries and orientations. Such differences provide antenna diversity in the disclosed invention. At higher frequencies, the antenna slot behaves as though it is effectively longer so that a plurality of higher resonance modes can be excited. These features lead to variation in the antenna signals as well as opportunity for pattern diversity. For example, in the UHF frequency band, the antenna slot can be excited at various points that are one-quarter wavelength apart to generate a variety of antenna gain patterns.

While the invention has been described and illustrated by reference to certain preferred embodiments and implementations, it should be understood that various modifications may be adopted without departing from the spirit of the invention or the scope of the following claims such as more than two feed lines may be combined to further enhance the antenna bandwidth or add more resonate bands to a slot antenna.

What is claimed is:

1. An antenna that is included in a window assembly, said antenna comprising:

a transparency ply having a surface that is defined within an outer perimeter edge;

a frame that is electrically conductive, said frame having a portal surface that defines an opening in said frame for receiving said transparency ply;

an electrically conductive coating that is located on the surface of said transparency ply, said electrically conductive coating being partially transparent and having an outer peripheral edge that is spaced inwardly away from at least a portion of the outer perimeter edge of said transparency ply;

a bus bar that has higher electrical conductivity than the electrical conductivity of said electrically conductive coating, said bus bar covering at least a portion of the outer peripheral edge of said electrically conductive coating such that part of said bus bar is on a portion of said electrically conductive coating that is laterally adjacent to the outer peripheral edge of said conductive coating and another part of said bus bar faces a portion of the surface of said transparency ply that is laterally adjacent to the outer peripheral edge of said electrically conductive coating, said bus bar having a first side that is located laterally between the outer peripheral edge of said electrically conductive coating and the portal surface of said frame, the first side of said bus bar being parallel to the portal surface of said frame and cooperating with the portal surface of said frame and with said electrically conductive coating to define an antenna slot that has a longitudinal dimension that is parallel to the longitudinal dimension of said bus bar, said antenna slot having a longitudinal dimension such that electrical signals having a selected fundamental frequency resonate in said slot;

a feed line that is located laterally on said transparency ply between the first side of said bus bar and the perimeter edge of said transparency ply, said feed line extending longitudinally in said antenna slot between a first end and a second end that is disposed on said feed line oppositely from said first end; and a first antenna feed link that is electrically connected to said feed line, said first antenna feed link also being electrically connected to said bus bar at a first feed point that is located within said antenna slot and at a longitudinal position of said bus bar where a signal that resonates in said antenna slot at a fundamental frequency has maximum electric field strength and also where a signal that resonates in said antenna slot at a higher order than said fundamental frequency also has maximum electric field strength.

2. The antenna of claim 1 wherein said first antenna feed link is electrically connected to said bus bar at a single feed point, said maximum electric field strength of said fundamental frequency signal in said antenna slot and said maximum electric field strength of said higher order resonant signal in said antenna slot occurring at said single feed point in said antenna slot.

3. The antenna of claim 1 wherein said antenna feed link is electrically connected to a first longitudinal position of said bus bar within said antenna slot at which said maximum electric field strength of said fundamental resonate signal occurs, and wherein said antenna feed link also is electrically connected to a second longitudinal position of said bus bar within said antenna slot at which said maximum electric field strength of said higher order resonant signal occurs.

4. The antenna of claim 1 wherein said bus bar cooperates with the peripheral edge of said electrically conductive coating to define one side of said slot antenna and wherein the portal side of said frame defines the opposite side of said antenna slot.

5. The antenna of claim 1 wherein said antenna slot supports additional resonance modes in which the resonant frequency is higher than the fundamental frequency.

6. The antenna of claim 5 wherein said each of said resonance modes have respective field distributions with minimum and maximum field strengths that are located at longitudinal positions on said antenna slot in accordance with the dimensions of said antenna slot and the geometry of the portal surface of said frame.

7. The antenna of claim 1 wherein said antenna includes a voltage probe that feeds said slot antenna, and said feed line being directly connected to said bus bar and oriented orthogonal to the longitudinal dimension of said slot.

8. The antenna of claim 1 wherein said antenna feed line is a coupled coplanar line that is laterally spaced between the first side of said bus bar and the portal surface of said frame.

9. The antenna of claim 2 wherein said first antenna feed link excites more than one resonance mode and wherein said single feed point is at the respective maximum fields of each of said resonance modes.

10. The antenna of claim 1 further comprising a second antenna feed link that excites a second higher order resonance mode that has a higher order than said fundamental resonance mode, said second antenna feed link being located a distance along the longitudinal dimension of said antenna slot that is at least one-fourth of the wavelength at the fundamental frequency from said first antenna feed link.

11. The antenna of claim 10 wherein the length of said second antenna feed link is one-fourth of the wavelength at the frequency of said second resonance mode, said second antenna feed link having one longitudinal end that is connected to said bus bar ata second feed point and a second longitudinal end that terminates as a distal end.

12. The antenna of claim 10 wherein said first antenna feed link in combination with said second antenna feed link and said frame form a coupled transmission line wherein the electrical impedance at said second feed point is lower than the impedance at said first feed point for signals at the frequency of said second resonance mode.

13. The antenna of claim 10 wherein an additional higher order resonance mode of said second antenna feed link combines in phase with the second higher order resonance mode of said second antenna feed link while maintaining the frequencies of other resonant frequency signals in said antenna slot within predetermined limits.

14. The antenna of claim 12 wherein the length of said coupled transmission line is selected to expand the bandwidth of the slot antenna or to establish a multiband antenna having at least one additional resonate frequency band.

15. The antenna of claim 10 wherein said second antenna feed link is connected to said feed line to form a dual feed for said slot antenna.

16. The antenna of claim 15 wherein the connecting point of said second antenna feed link to said feed line is selected such that the higher-order resonance mode of said second antenna feed link combines in-phase with the higher-order resonance mode of said first antenna feed link while maintaining the frequencies of other resonant frequency bands in said antenna slot within predetermined limits.

17. The antenna of claim 16 wherein the length of said connected dual feed is selected to strengthen the antenna signal over a given bandwidth, broaden the bandwidth of the antenna signal, or establish a multiband antenna by adding at least one resonant frequency.

18. The antenna of claim 1 comprising at least one coplanar feed line and at least one voltage probe that are used in combination to feed said antenna slot, each said coplanar feed line and each voltage probe being located in said antenna slot at respective locations that are spaced apart from each other to provide an antenna diversity system that excites different modes of the slot antenna, each of said coplanar feed lines and said voltage probes providing a respective field distribution having a different pattern than coplanar feed lines and voltage probes at other locations of said antenna slot.

19. The antenna of claim 15 wherein at least one additional feed line is added to expand the bandwidth of the slot antenna or to establish a multiband antenna having at least one additional resonate frequency band.

20. The antenna of claim 18 wherein at least one additional feed line is added to expand the bandwidth of the slot antenna or to establish a multiband antenna having at least one additional resonate frequency band.

* * * * *